US010151168B2

(12) United States Patent
Hallundbæk et al.

(10) Patent No.: US 10,151,168 B2
(45) Date of Patent: Dec. 11, 2018

(54) DOWNHOLE EXPANDABLE TUBULAR

(71) Applicant: Welltec Oilfield Solutions AG, Zug (CH)

(72) Inventors: Jørgen Hallundbæk, Græsted (DK); Lars Stæhr, Glostrup (DK)

(73) Assignee: Welltec Oilfield Solutions AG, Zug (CH)

( * ) Notice: Subject to any disclaimer, the term of this patent is extended or adjusted under 35 U.S.C. 154(b) by 140 days.

(21) Appl. No.: 14/780,712

(22) PCT Filed: Apr. 11, 2014

(86) PCT No.: PCT/EP2014/057369
§ 371 (c)(1),
(2) Date: Sep. 28, 2015

(87) PCT Pub. No.: WO2014/167096
PCT Pub. Date: Oct. 16, 2014

(65) Prior Publication Data

US 2016/0326830 A1 Nov. 10, 2016

(30) Foreign Application Priority Data

Apr. 12, 2013 (EP) ..... 13163519

(51) Int. Cl.
*E21B 33/12* (2006.01)
*E21B 43/10* (2006.01)

(52) U.S. Cl.
CPC ..... *E21B 33/1208* (2013.01); *E21B 43/103* (2013.01)

(58) Field of Classification Search
CPC ..... E21B 33/12; E21B 33/1208; E21B 43/10; E21B 43/103
See application file for complete search history.

(56) References Cited

U.S. PATENT DOCUMENTS 2,921,632 A * 1/1960 Clark, Jr. ..... E21B 33/1216 277/338
7,234,533 B2 6/2007 Gambier
(Continued)

FOREIGN PATENT DOCUMENTS

CN 102272413 A 12/2011
CN 102575508 A 7/2012
(Continued)

OTHER PUBLICATIONS

International Preliminary Report on Patentability dated Oct. 22, 2015 issued in PCT/EP2014/057369 (9 pages).
(Continued)

*Primary Examiner* — Nicole Coy
*Assistant Examiner* — Dany E Akakpo
(74) *Attorney, Agent, or Firm* — Nixon & Vanderhye P.C.

(57) ABSTRACT

The present invention relates to a downhole expandable tubular to be expanded in a well downhole from a first outer diameter to a second outer diameter to abut against an inner face of a casing or borehole, the downhole expandable tubular having an outer face and a longitudinal extension and comprising at least one first circumferential edge and at least one second circumferential edge provided on the outer face and spaced apart in the longitudinal extension, wherein a sealing element and a split ring-shaped retaining element are arranged between the first and second circumferential edges, the split ring-shaped retaining element forming a back-up for the sealing element and wherein the split ring-shaped retaining element has more than one winding, so that when the expandable tubular is expanded from the first outer diameter to the second outer diameter, the split ring-shaped retaining element partly unwinds. Furthermore, the present invention relates to an annular barrier.

24 Claims, 17 Drawing Sheets

(56) References Cited

U.S. PATENT DOCUMENTS

| | | | | |
|---|---|---|---|---|
| 7,347,274 | B2 * | 3/2008 | Patel | E21B 33/128 166/120 |
| 7,543,639 | B2 | 6/2009 | Emerson | |
| 2008/0302543 | A1 * | 12/2008 | O'Connor | E21B 33/10 166/387 |
| 2010/0038072 | A1 * | 2/2010 | Akselberg | E21B 33/1212 166/118 |
| 2012/0205873 | A1 * | 8/2012 | Turley | E21B 33/1216 277/336 |
| 2016/0222754 | A1 | 8/2016 | Hallundbæk | |

FOREIGN PATENT DOCUMENTS

| | | | |
|---|---|---|---|
| EP | 1 624 152 | A2 | 2/2006 |
| GB | 2296520 | A | 7/1996 |
| RU | 2236550 | C1 | 9/2004 |
| RU | 59120 | U1 | 12/2006 |
| WO | WO2006012530 | | 2/2006 |
| WO | 2007/021975 | A1 | 2/2007 |
| WO | WO2007021975 | | 2/2007 |
| WO | WO 2010/079237 | A1 | 7/2010 |

OTHER PUBLICATIONS

Chinese Office Action dated Mar. 20, 2017 in Chinese Application No. 201480018770.7, with English Translation (17 pages).

International Search Report for PCT/EP2014/057369, dated May 26, 2014, 3 pages.

Written Opinion of the ISA or PCT/EP2014/057369, dated May 26, 2014, 7 pages.

Decision to Grant issued in related Russian Application No. 2015145875/03 (070689) with English translation, dated Nov. 16, 2017, 18 pages.

Search Report issued in related Russian Application No. 2015145875/03 (070689) with English translation, dated Sep. 28, 2017, 4 pages.

* cited by examiner

DOWNHOLE EXPANDABLE TUBULAR

This application is the U.S. national phase of International Application No. PCT/EP2014/057369 filed 11 Apr. 2014, which designated the U.S. and claims priority to EP Patent Application No. 13163519.5 filed 12 Apr. 2013, the entire contents of each of which are hereby incorporated by reference.

FIELD OF THE INVENTION

The present invention relates to a downhole expandable tubular to be expanded in a well downhole. Furthermore, the present invention relates to an annular barrier.

BACKGROUND ART

In wellbores, expandable tubulars are used for different purposes, such as for sealing off an opening in the casing, in the form of a patch or liner, for providing a barrier to flow between an inner and an outer tubular structure, or between an inner tubular structure and the inner wall of the borehole, in the form of an annular barrier, or for providing a liner hanger.

When the expandable tubulars are being used to seal off e.g. an opening or a zone, separate sealing elements are often provided on an exterior face of the expandable tubular for enhancing the sealing properties. However, it has been experienced that it is difficult to control the position of the sealing element during expansion of the expandable tubulars, causing the sealing element to possibly be displaced from its intended position, whereby there is a risk that the sealing properties may not be as intended.

SUMMARY OF THE INVENTION

It is an object of the present invention to wholly or partly overcome the above disadvantages and drawbacks of the prior art. More specifically, it is an object to provide a downhole expandable tubular with enhanced sealing properties.

The above objects, together with numerous other objects, advantages and features, which will become evident from the below description, are accomplished by a solution in accordance with the present invention by a downhole expandable tubular to be expanded in a well downhole from a first outer diameter to a second outer diameter to abut against an inner face of a casing or borehole, the downhole expandable tubular having an outer face and a longitudinal extension and comprising at least one first circumferential edge and at least one second circumferential edge provided on the outer face and spaced apart in the longitudinal extension, wherein a sealing element and a split ring-shaped retaining element are arranged between the first and second circumferential edges, the split ring-shaped retaining element forming a back-up for the sealing element and wherein the split ring-shaped retaining element has more than one winding, so that when the expandable tubular is expanded from the first outer diameter to the second outer diameter, the split ring-shaped retaining element partly unwinds.

Hereby, it is obtained that the split ring-shaped retaining element ensures that the sealing element is maintained in the longitudinal extension of the downhole expandable tubular even when it is being expanded, so that the sealing element retains its intended position and the sealing properties of the downhole expandable tubular are enhanced. The sealing element may withstand a higher pressure on the side where the split ring-shaped retaining element is positioned, since the split ring-shaped retaining element functions as a back-up and support system for the sealing element.

Furthermore, the split ring-shaped retaining element may be arranged in an abutting manner to the sealing element.

Also, the split ring-shaped retaining element may preferably be made of material having a yield strength of at least 69 MPa, preferably at least 100 MPa.

In an embodiment, the split ring-shaped retaining element may unwind by less than one winding when the expandable tubular is expanded from the first outer diameter to the second outer diameter.

The more than one winding of the split ring-shaped retaining element may abut each other along the ring-shaped retaining element.

Moreover, the more than one winding of the split ring-shaped retaining element may be helically wound around the downhole expandable tubular.

Also, the split ring-shaped retaining element may have more than one winding in the second outer diameter of the downhole expandable tubular.

Furthermore, the split ring-shaped retaining element may have a width in the longitudinal extension, the width being substantially the same in the first outer diameter and the second outer diameter of the downhole expandable tubular.

In an embodiment, the split ring-shaped retaining element may have a plurality of windings.

The downhole expandable tubular according to the present invention may have a first thickness between the first and second circumferential edges and a second thickness in adjacent areas, the first thickness being smaller than the second thickness.

Hereby, it is obtained that expansion of the downhole expandable tubular is facilitated between the first and second circumferential edges, so that the downhole expandable tubular may expand more in this area than in the adjacent areas, whereby the sealing element may be further forced against the inner face of a casing or borehole.

Moreover, the split ring-shaped retaining element may, while partly unwinding, increase in outer diameter in at least one end.

Further, the split ring-shaped retaining element and the sealing element may substantially fill a gap provided between the first and second circumferential edges.

In an embodiment, the split ring-shaped retaining element may be made of a metallic material.

In another embodiment, the split ring-shaped retaining element may be made of a spring material.

Also, the split ring-shaped retaining element may have an inner diameter, the inner diameter being substantially equal to an outer diameter of the downhole expandable tubular between the first and second circumferential edges.

In one embodiment, the split ring-shaped retaining element may have a square cross-section.

In another embodiment, the split ring-shaped retaining element may have a circular cross-section.

Moreover, the sealing element may be partially cone-shaped.

A plurality of sealing elements may be arranged between the first and second circumferential edges.

Additionally, the split ring-shaped retaining element may be arranged on a first side of the sealing element, and a second split ring-shaped retaining element may be arranged on another side of the sealing element opposite the first side.

Also, the split ring-shaped retaining element may retain the sealing element in a position along the longitudinal extension of the downhole expandable tubular while expanding the split ring-shaped retaining element and the sealing element.

Moreover, the ring-shaped retaining element may be a split ring.

Further, the first and second circumferential edges may be part of a groove provided in the outer face of the downhole expandable tubular.

The downhole expandable tubular according to the present invention may comprise al least two projections providing the circumferential edges.

Moreover, the first and second circumferential edges may be extending in a radial extension in relation to the downhole expandable tubular, said radial extension being perpendicular to the longitudinal extension of the downhole expandable tubular.

In addition, an intermediate element may be arranged between the split ring-shaped retaining element and the sealing element.

Said split ring-shaped retaining element may partly overlap the intermediate element.

Further, the split ring-shaped retaining element and the intermediate element may be arranged in an abutting manner to the sealing element, so that at least one of the split ring-shaped retaining element and the intermediate element may abut the sealing element.

Additionally, the sealing element may be made of an elastomer, rubber, polytetrafluoroethylene (PTFE) or another polymer.

Also, the intermediate element may be made of a flexible material. The flexible material may be Polytetrafluoroethylene (PTFE) as a base material with for instance brass, carbon and/or stainless steel contained therein.

Furthermore, the downhole expandable tubular may be made from one tubular metal blank.

The blank may be made by centrifugal casting or spin casting.

In an embodiment, the first and second circumferential edges may be provided by machining the blank.

The downhole expandable tubular according to the present invention may be machined from the blank by means of grinding, milling, cutting or latheing or by means of a similar method.

Moreover, the downhole expandable tubular may comprise a plurality of circumferential edges, projections and/or grooves along the longitudinal extension of the downhole expandable tubular.

Further, the downhole expandable tubular may be a patch to be expanded within a casing or well tubular structure in a well, a liner hanger to be at least partly expanded within a casing or well tubular structure in a well, or a casing to be at least partly expanded within another casing.

Also, the downhole expandable tubular may be provided with at least one circumferential projection.

The present invention also relates to an annular barrier to be expanded in an annulus between a well tubular structure and an inside wall of a borehole or a casing downhole for providing zone isolation between a first zone and a second zone of the borehole, comprising:

- a tubular part for mounting as part of the well tubular structure,
- a downhole expandable tubular as mentioned above, surrounding the tubular part and having an outer face facing towards the inside wall of the borehole or the casing, each end of the downhole expandable tubular being connected with the tubular part,
- a space between the downhole expandable tubular and the tubular part, and
- an expansion opening in the tubular part through which fluid may enter into the space in order to expand the downhole expandable tubular.

Also, a sleeve may be arranged in between the downhole expandable tubular and the tubular part in the annular barrier, the sleeve being connected with the tubular part and the downhole expandable tubular, thus dividing the space into a first space section and a second space section.

The annular barrier according to the present invention may comprise several sleeves squeezed in between the tubular part and the downhole expandable tubular.

Furthermore, the downhole expandable tubular may have an opening providing fluid communication between the first or the second zone and one of the space sections.

Additionally, the projection may be a ring-shaped projection of an increased thickness in relation to other parts of the downhole expandable tubular, the ring-shaped projection providing an enforcement of the annular barrier when the annular barrier is expanded.

Moreover, the present invention relates to a downhole completion comprising a downhole expandable tubular as described above and a casing having an inner face against which at least part of the downhole expandable tubular may be expanded.

Also, the present invention relates to a downhole completion comprising a well tubular structure and an annular barrier as described above, where the tubular part of the annular barriers may be mounted as part of the well tubular structure.

Finally, the present invention relates to a method for positioning and maintaining a sealing element on a downhole expandable tubular while the downhole expandable tubular is expanded from a first outer diameter to a second outer diameter, comprising the steps of:

- arranging a sealing element circumferentially about the downhole expandable tubular between a first edge and second edge provided on an outer face of the downhole expandable tubular, and
- arranging a split ring-shaped retaining element about the downhole expandable tubular between the first edge and the sealing element, so that the split ring-shaped retaining element and the sealing element substantially fill out a gap between the first and second edges.

In an embodiment, an intermediate element may be arranged between the split ring-shaped retaining element and the sealing element.

The split ring-shaped retaining element may be arranged on a first side of the sealing element, and a second split ring-shaped retaining element may be arranged on another side of the sealing element opposite the first side.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
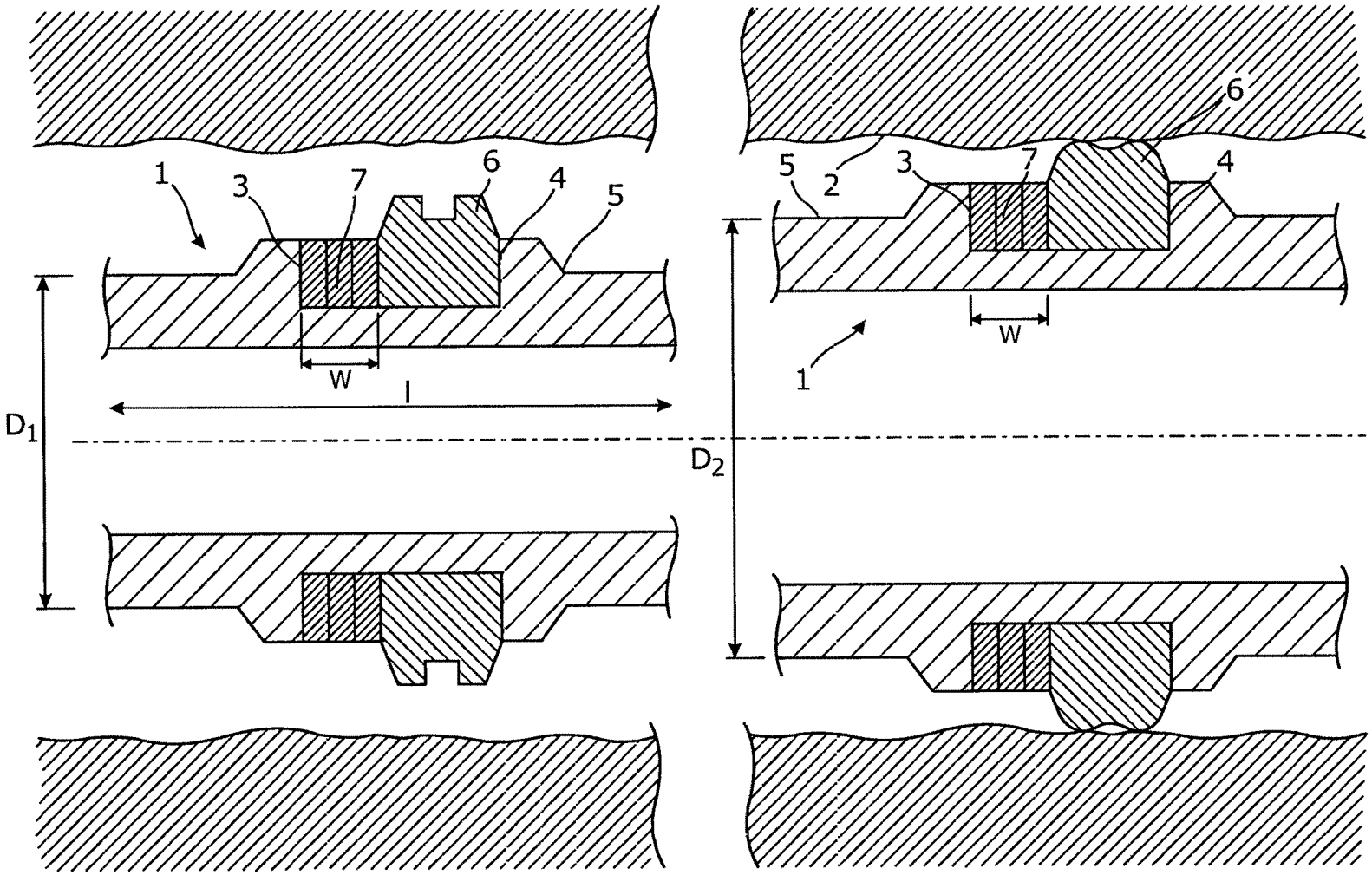
FIG. 1 shows a cross-sectional part of the downhole expandable tubular in a non-expanded and expanded position, respectively.

FIG. 1 shows a cross-sectional part of a downhole expandable tubular 1 according to the present invention in a non-expanded (left side of FIG. 1) and expanded position (right side of FIG. 1), respectively. The downhole expandable tubular 1 is to be expanded in a well downhole from a first outer diameter $D_1$ to a second outer diameter $D_2$ in order to, in this embodiment, abut against an inner face 2 of a borehole.

The downhole expandable tubular 1 has a longitudinal extension I and comprises at least one first circumferential edge 3 and at least one second circumferential edge 4 provided on an outer face 5 of the downhole expandable tubular 1 and spaced apart in the longitudinal extension. Furthermore, a sealing element 6 and a split ring-shaped retaining element 7 are arranged between the first and second circumferential edges 3, 4. The split ring-shaped retaining element 7 has more than one winding, so that when the downhole expandable tubular is expanded from the first outer diameter $D_1$ to the second outer diameter $D_2$, the windings of the split ring-shaped retaining element 7 partly unwinds. In the embodiment shown in FIG. 1, the split ring-shaped retaining element 7 has three windings. However, in other embodiments it may have two, four, five, six or seven windings, and even a higher number of windings is possible. The split ring-shaped retaining element 7 and the sealing element 6 occupy the gap between the first and second circumferential edges 3, 4. Thus, the split ring-shaped retaining element 7 is arranged in an abutting manner to the sealing element. Hereby, it is obtained that the split ring-shaped retaining element 7 ensures that the sealing element 6 is maintained and supported in the longitudinal extension of the downhole expandable tubular 1 even when it is being expanded, so that the sealing element 6 retains its intended position and the sealing properties of the downhole expandable tubular 1 are enhanced. Furthermore, tests have shown that the sealing element may withstand a higher pressure on the side where the split ring-shaped retaining element is positioned, since the split ring-shaped retaining ring functions as a back-up and support system for the sealing element. In addition, the split ring-shaped retaining element 7 has a width w in the longitudinal extension I, the width w being substantially the same in the first outer diameter $D_1$ and the second outer diameter $D_2$ of the downhole expandable tubular 1.

Figure 2:
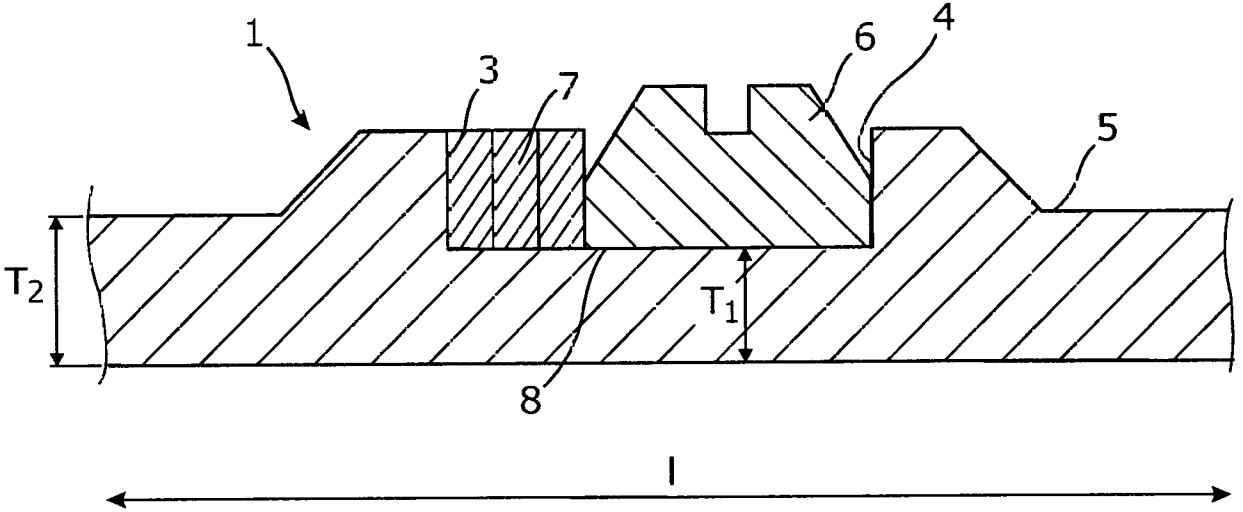
FIGS. 2-7 show in cross-sectional views of different embodiments of the split ring-shaped retaining element and sealing element arranged between a first and a second circumferential edge of the downhole expandable tubular.

FIG. 2 shows an enlarged cross-sectional view of the downhole expandable tubular 1 shown in FIG. 1. The sealing element 6 abuts the second edge 4, and the split ring-shaped retaining element 6 is arranged between the first edge 3 and the sealing element 6. The split ring-shaped retaining element 7 has three windings and each winding has a square cross-section. In this embodiment, the first and second circumferential edges 3, 4 are part of a groove 8 provided in the outer face 5 of the downhole expandable tubular 1. The first and second circumferential edges 3, 4 are extending in a radial extension in relation to the downhole expandable tubular 1, said radial extension being substantially perpendicular to the longitudinal extension I of the downhole expandable tubular 1.

The downhole expandable tubular 1 has a first thickness $T_1$ between the first and second circumferential edges 3, 4, i.e. in the groove 8, and a second thickness $T_2$ in adjacent areas, the first thickness $T_1$ being smaller than the second thickness $T_2$. Hereby, it is obtained that expansion of the downhole expandable tubular 1 is facilitated between the first and second circumferential edges 3, 4, so that the downhole expandable tubular 1 may expand more in this area than in the adjacent areas, whereby the sealing element 6 may be further forced against the inner face of a casing or borehole (not shown).

Figure 3:
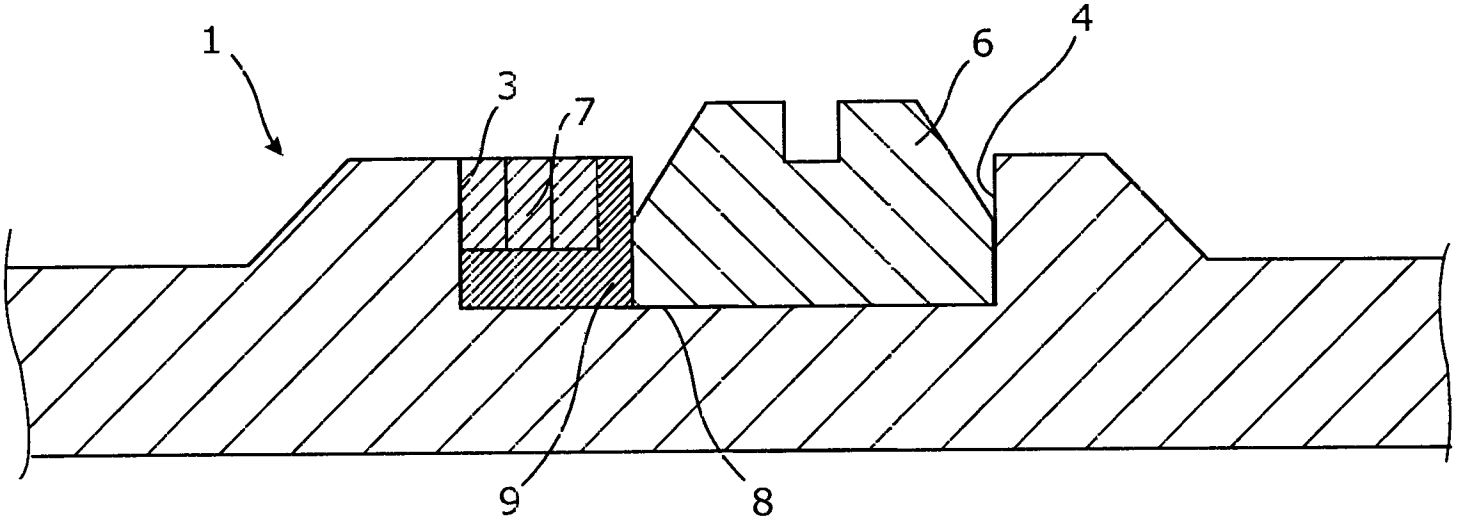

FIG. 3 shows another embodiment of the downhole expandable tubular 1 wherein an intermediate element 9 is arranged between the split ring-shaped retaining element 7 and the sealing element 6. In this embodiment, the split ring-shaped retaining element 7 partly overlaps the intermediate element 9. The intermediate element 9 may be made of a flexible material and is adapted to maintain the split ring-shaped retaining element 7 in position and function as protection and support of the sealing element 6. The split ring-shaped retaining element 7, the intermediate element 9 and the sealing element 6 are placed in the groove 8 between the first and second circumferential edges 3, 4.

Figure 4:
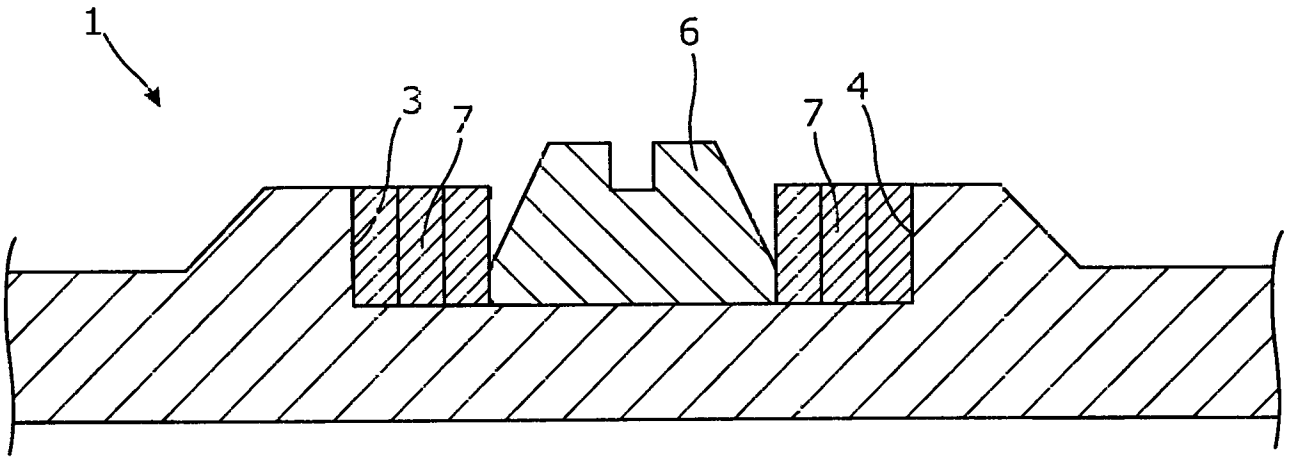

FIG. 4 shows an embodiment of the downhole expandable tubular 1, wherein the split ring-shaped retaining element 7 is arranged on a first side of the sealing element 6 and a second split ring-shaped retaining element 7 is arranged on another side of the sealing element 6 opposite the first side. The two second split ring-shaped retaining element 7 and the sealing element 6 are arranged in the groove 8 between the first and second circumferential edges 3, 4.

Figure 5A:
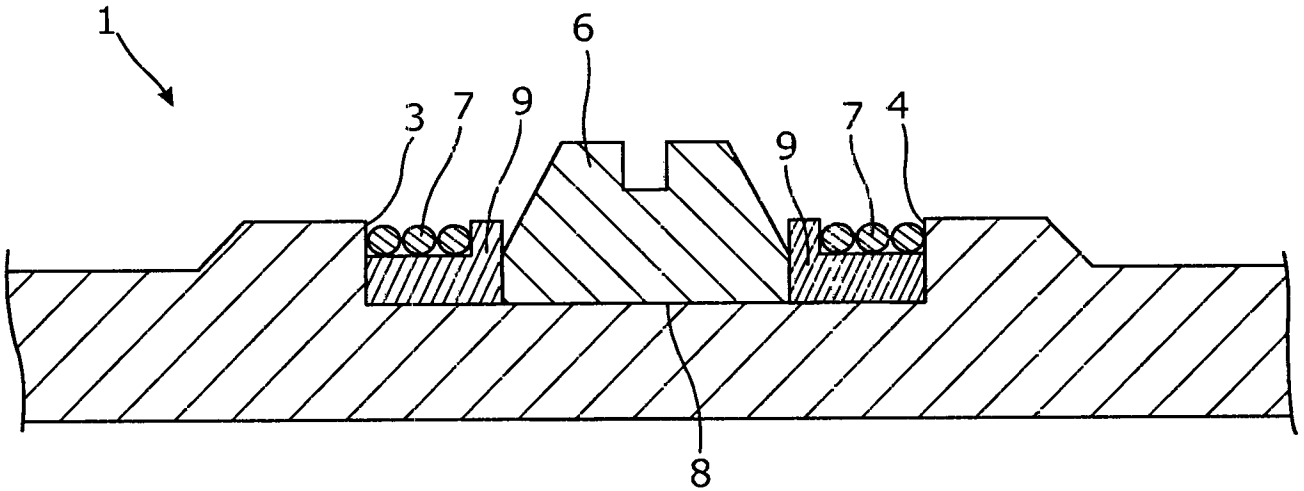

FIG. 5*a* shows an embodiment of the downhole expandable tubular 1, wherein first and second intermediate elements 9 are arranged between the split ring-shaped retaining elements 7 and the sealing element 6. In this embodiment, the windings of the split ring-shaped retaining elements 7 have a round cross-section and partly overlap the intermediate elements 9. In the same manner as shown in the preceding figures, the elements are arranged in the groove 8 between the first and second circumferential edges 3, 4.

Figure 5B:
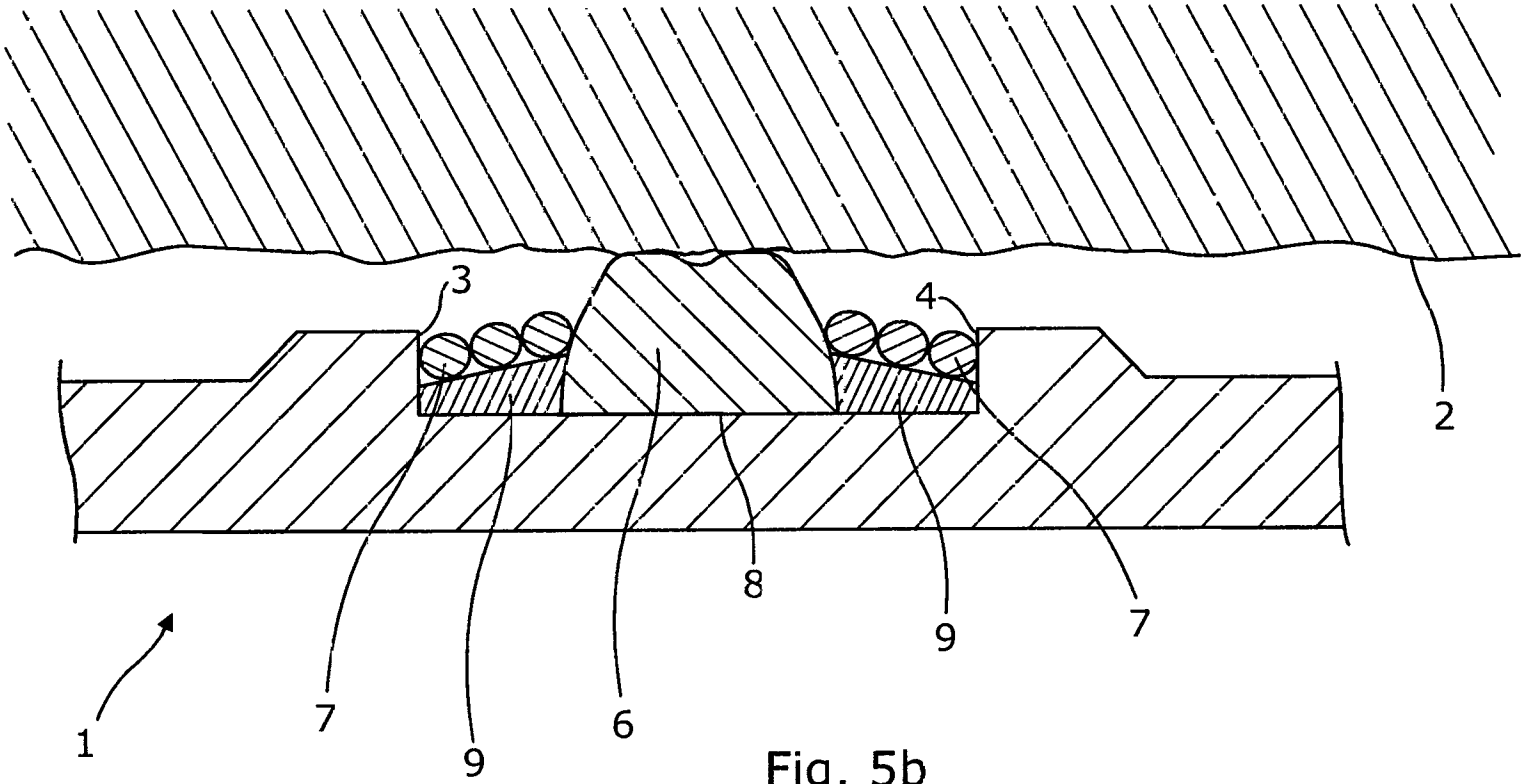

FIG. 5*b* shows the embodiment of the downhole expandable tubular 1 of FIG. 5*a* in an expanded position up against an inner face 2 of a borehole or a casing. The intermediate elements 9 may preferably be made of a flexible material such as reinforced Teflon, i.e. Polytetrafluoroethylene (PTFE) as a base material with for instance brass, carbon and/or stainless steel parts, such as fibres, contained therein.

Accordingly, the intermediate elements 9 may change their geometrical shapes during expansion and due to the pressure present in the annulus, so that the intermediate elements become triangular in their cross-sections as shown in FIG. 5*b*, whereby the intermediate elements slope away from the sealing element 6 to the circumferential edges 3, 4. The split ring-shaped retaining elements 7 overlap the intermediate elements 9 and thus also have an inclined extension in the longitudinal extension of the downhole expandable tubular. Hereby it is obtained that the split ring-shaped retaining elements 7 and the intermediate elements 9 together function as back-up and support systems for the sealing element b, causing the sealing element 6 to be able to withstand high pressures on both sides of the sealing element 6 before losing its sealing properties.

Figure 6:
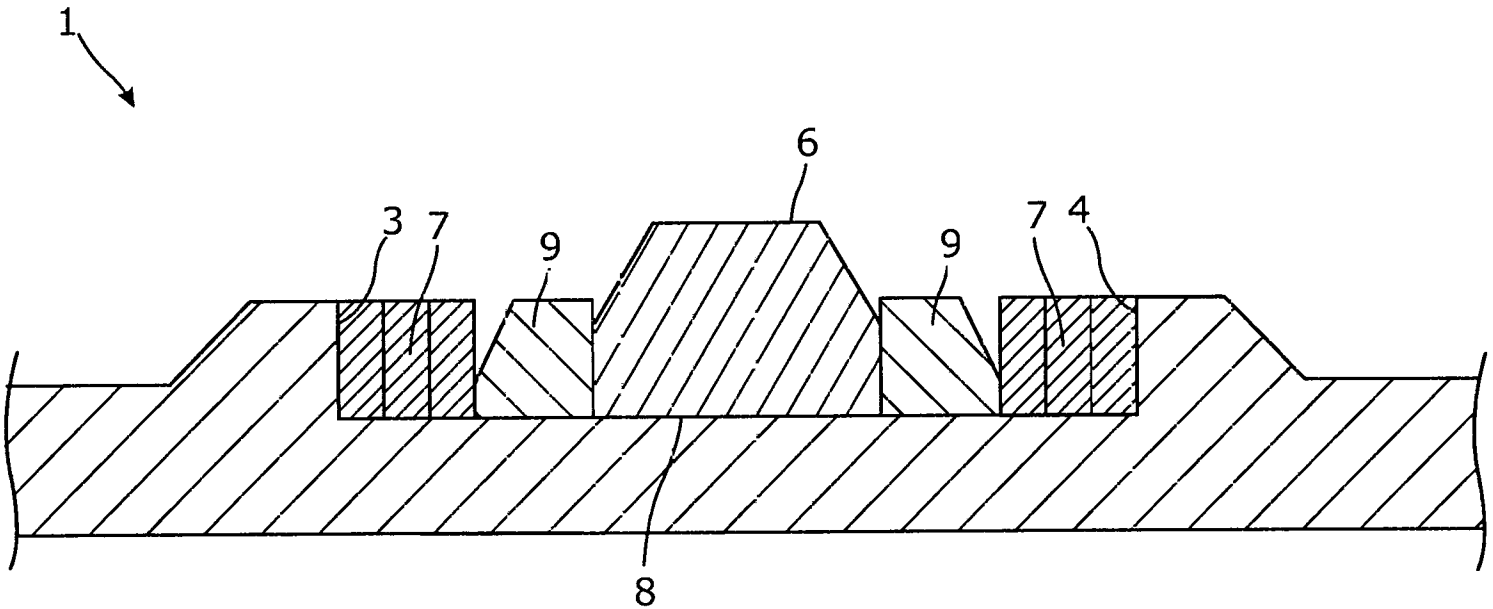

FIG. 6 shows yet another embodiment of the downhole expandable tubular 1, wherein first and second intermediate elements 9 are also arranged between the split ring-shaped retaining elements 7 and the sealing element 6. In this embodiment, the intermediate elements 9 have another shape than shown in FIGS. 3 and 5, and the windings of the split ring-shaped retaining elements 7 abut the intermediate elements on one side, and the opposite side of the split ring-shaped retaining elements 7 abut first and second circumferential edges 3, 4, respectively. All the elements are arranged in the groove 8 between the first and second circumferential edges 3, 4.

Figure 7:
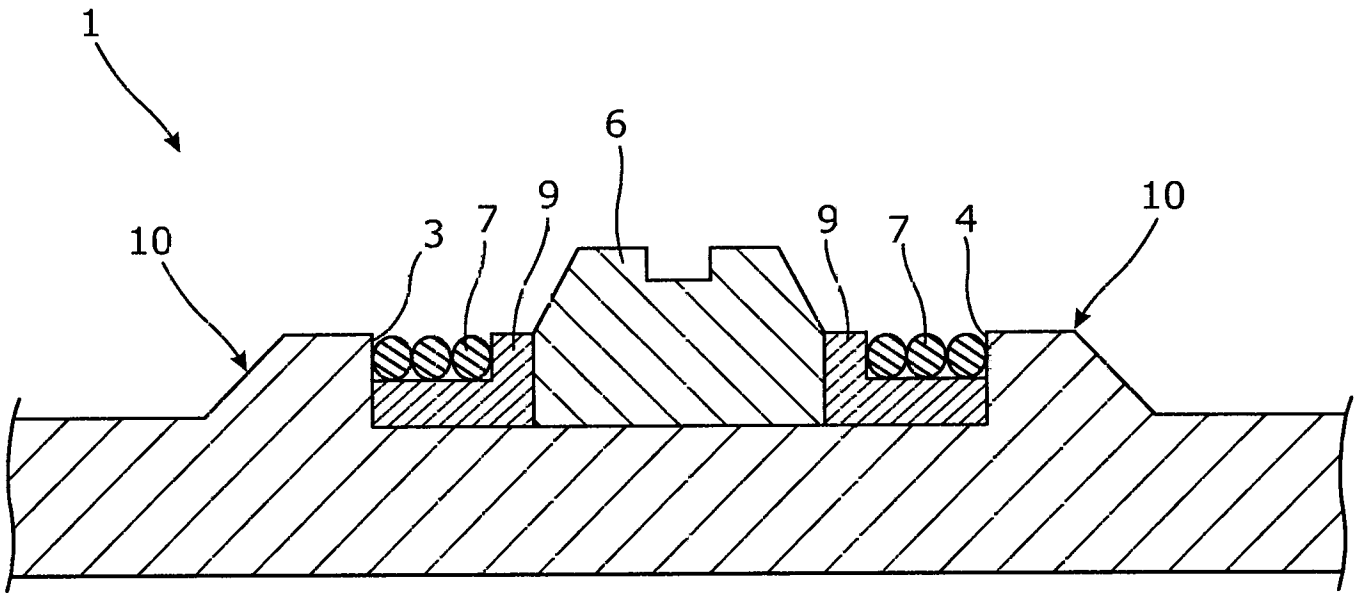

In FIG. 7, another embodiment of the downhole expandable tubular 1 is shown, wherein the downhole expandable tubular 1 comprises at least two projections 10 providing the first and second circumferential edges 3, 4. The sealing element 6, intermediate elements 9 and the split ring-shaped retaining elements 7 are arranged between the two projections 10, i.e. the first and second circumferential edges 3, 4, so that the intermediate elements 9 abut the sealing element from either side and the split ring-shaped retaining elements 7 are arranged outside the intermediate elements 9.

In the shown embodiments, only one sealing element is shown. In other not shown embodiments, a plurality of sealing elements may be arranged between the first and second circumferential edges. The sealing element is preferably made of a sealant material such as rubber or elastomeric material, polytetrafluoroethylene (PTFE) or another polymer, so that it is flexible and may be pushed up against an inner face. The sealing element may have different cross-sections, for instance cone-shaped or round, and it may comprise several projections.

Figure 8:
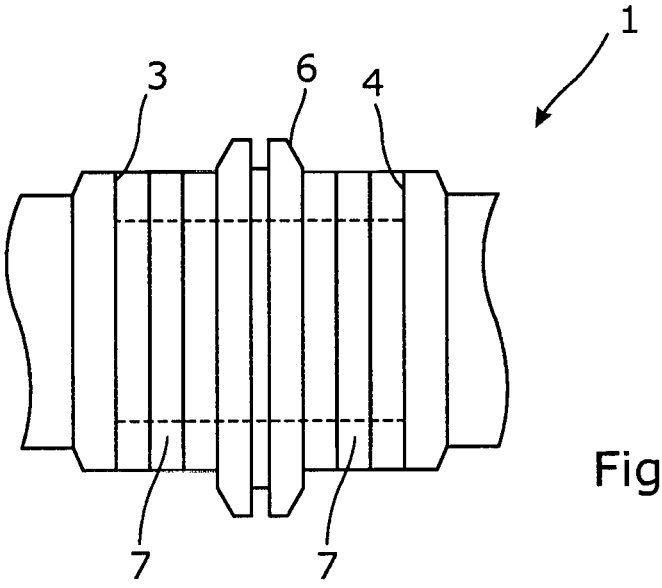
FIG. 8 shows a part of the downhole expandable tubular in a side view.

In FIG. 8, the downhole expandable tubular 1 is partly shown in an exterior side view. The split ring-shaped retaining elements 7 each has three windings extending around the downhole expandable tubular 1, and the sealing element 6 is also extending around the expandable tubular. The first and second circumferential edges 3, 4 are also extending circumferentially around the expandable tubular 1.

Figure 9:
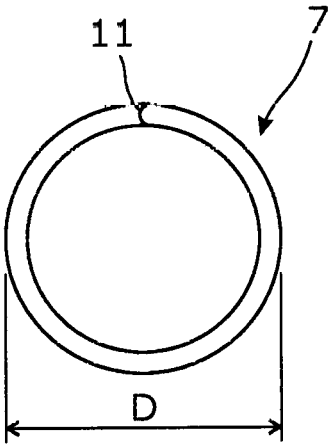
FIGS. 9-10 show the split ring-shaped retaining element.
Figure 10:
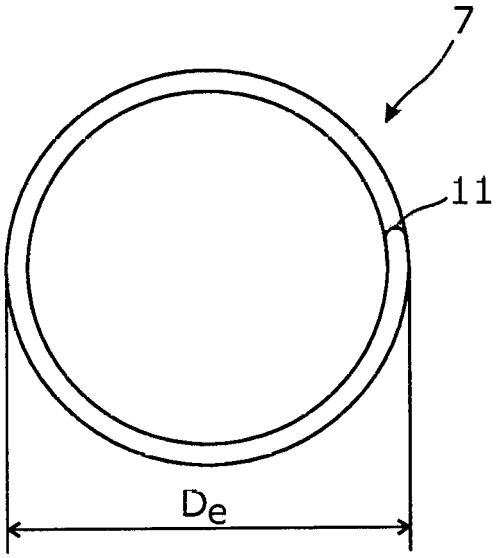
Figure 11A:
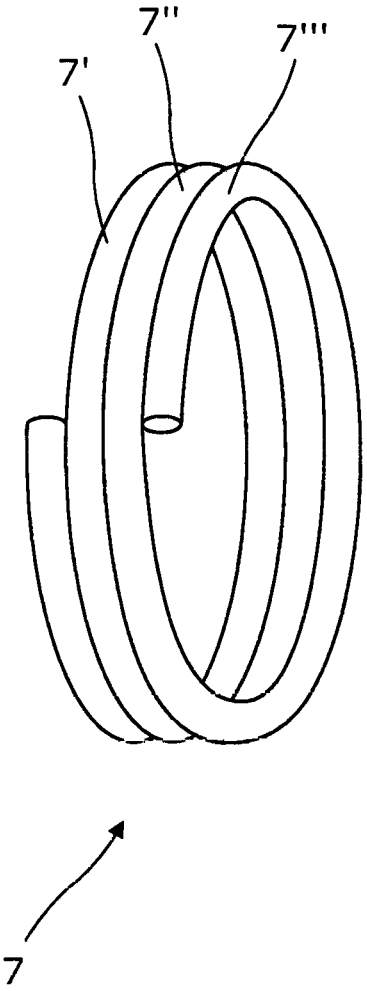
FIGS. 11*a-b* show the split ring-shaped retaining element in a perspective view.
Figure 11B:
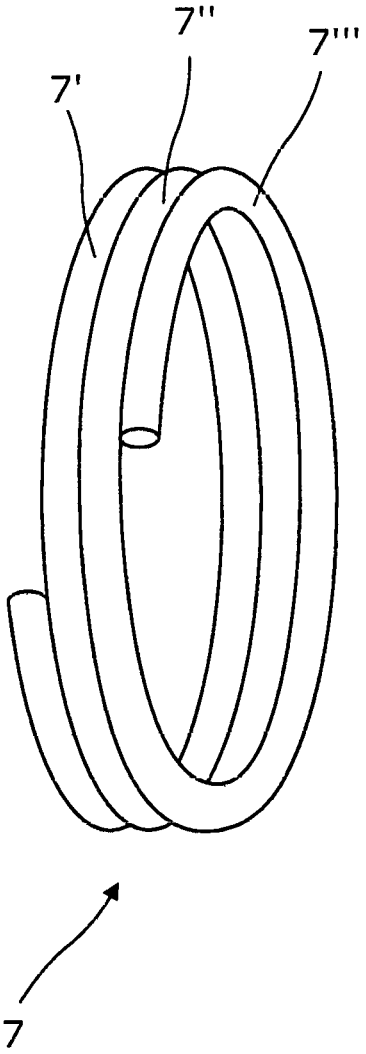

The split ring-shaped retaining element is preferably made of material having a yield strength of at least 69 MPa, preferably at least 100 MPa. The split ring-shaped retaining element is preferably made of a metallic material, such as a spring material, or polyether ether ketone (PEEK) or similar material. Since the split ring-shaped retaining element 7 comprises more than one winding and is made by metallic material, it will, when the downhole expandable tubular 1 is expanded, also be expanded. Hereby it is obtained that the split ring-shaped retaining element 7 will function as an efficient expandable steel back-up and support system for the sealing element. For instance, when the downhole expandable tubular is expanded by 30%, the split ring-shaped retaining element 7 is unwound by approximately 30% of the circumference of the split ring-shaped retaining element 7, and thus the split ring-shaped retaining element 7 decreases its number of windings so that it is still capable of closing the gaps in the longitudinal extension, whereby the sealing element, the split ring-shaped retaining elements and the intermediate elements (if present) fill out the gap between the first and second circumferential edges 3, 4. In FIGS. 9 and 10, a split ring-shaped retaining element 7 is shown. As described above, the split ring-shaped retaining element 7 comprises more than one winding which closely abut each other. During the expansion of the split ring-shaped retaining element 7, its diameter increases from D to $D_e$ as described above and shown in FIGS. 9 and 10. Due to the windings and the spring material, the windings will be displaced in relation to each other, and an end 11 of the split ring-shaped retaining element 7 will move from the position shown in FIG. 9 to the position shown in FIG. 10. FIGS. 11*a* and 11*b* show a perspective view of the split ring-shaped retaining element 7 in a non-expanded and expanded position, respectively, whereby it is deducible that the number of windings 7', 7'', 7''' of the split ring-shaped retaining element 7 decreases during expansion, since the perimeter or circumference of the split ring-shaped retaining element 7 increases during the expansion.

Figure 12:
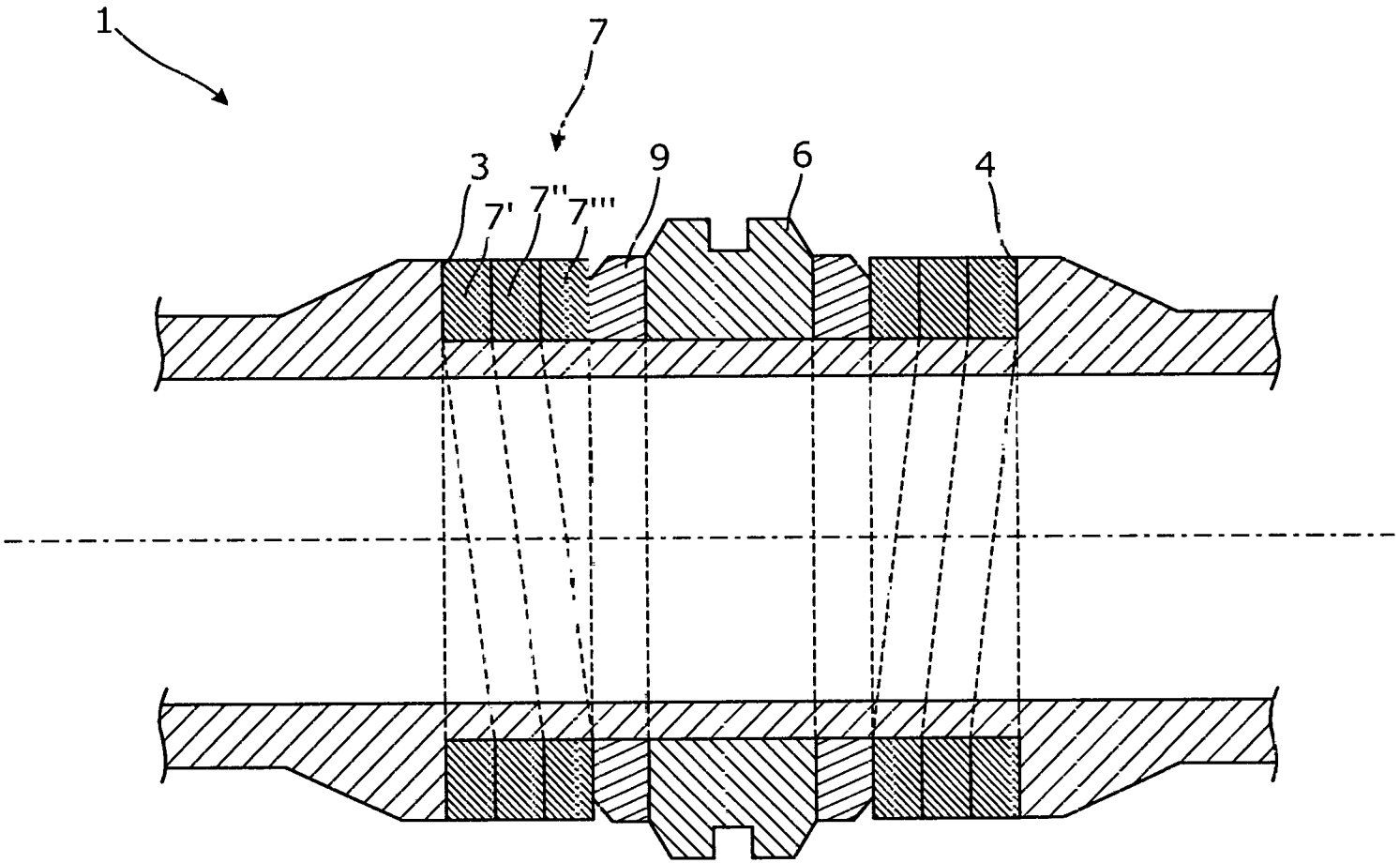
FIG. 12 shows a cross-sectional view of a part of the downhole expandable tubular.

As shown in FIG. 12, the split ring-shaped retaining elements 7 are arranged on opposite sides of the sealing element 6, containing and maintaining the sealing element 6 within its circumferential edges. The split ring-shaped retaining elements 7 may have approximately 3.5 windings, and after expansion of the downhole expandable tubular, the split ring-shaped retaining element 7 has approximately 2.7 windings and thus substantially maintains its extension and width in the longitudinal extension of the downhole expandable tubular 1, even though the Split ring-shaped retaining element 7 has been partly unwound. As shown in FIG. 11, the windings 7', 7'', 7''' of the split ring-shaped retaining element 7 are helically wound around the downhole expandable tubular 1.

Figure 13:
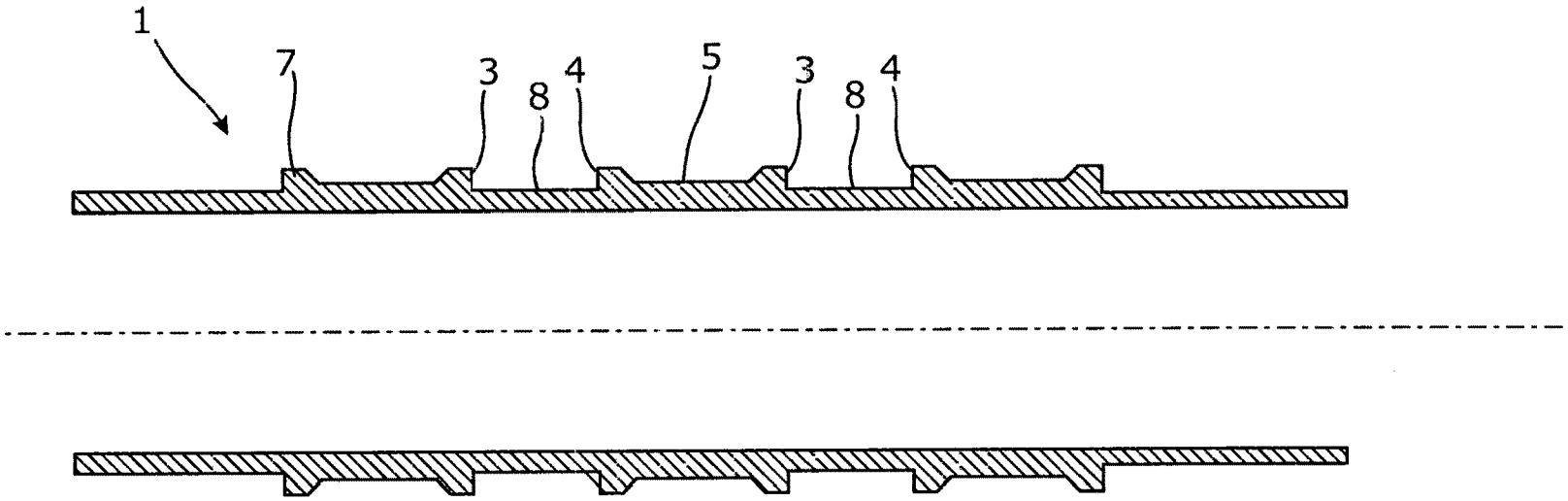
FIG. 13 shows a cross-sectional view of an embodiment of a downhole expandable tubular without the split ring-shaped retaining element and the sealing element.

In FIG. 13, the downhole expandable tubular 1 is shown without any split ring-shaped retaining element and sealing element. In this embodiment, it comprises two pairs of first and second circumferential edges 3, 4 and two grooves 8 provided in the outer face 5 of the downhole expandable tubular 1.

The downhole expandable tubular may be made from one tubular metal blank, wherein the blank may be made by centrifugal casting or spin casting. Furthermore, the first and second circumferential edges may be provided by machining the blank.

Figure 14:
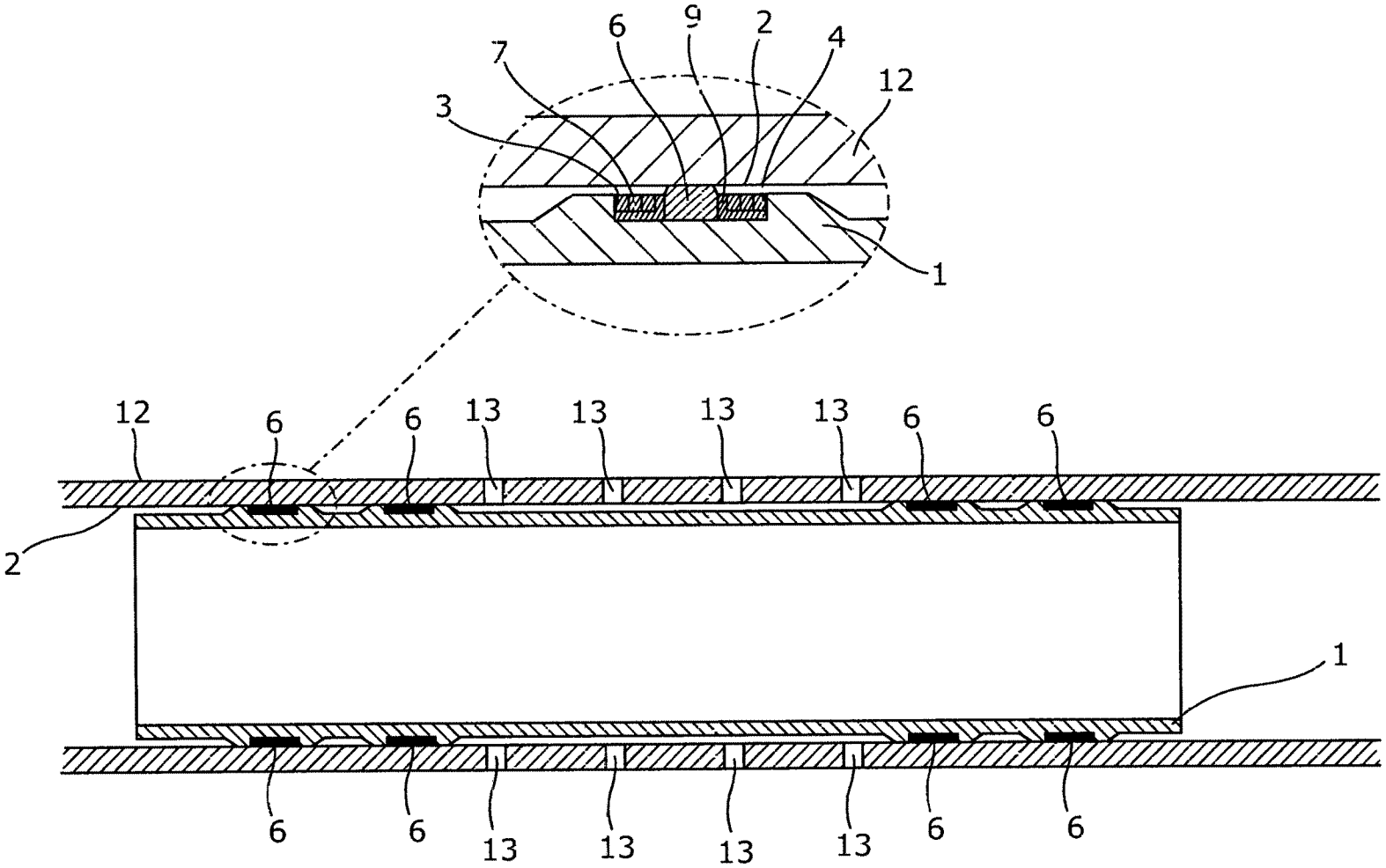
FIG. 14 shows a cross-sectional view of a downhole expandable tubular in the form of a patch.

In FIG. 14, the downhole expandable tubular 1 is a patch which is expanded within a casing 12 part of a well tubular structure in a well. The patch is typically used for sealing off a leak or a perforated zone of openings 13 in the casing. The downhole expandable tubular 1 is inserted into the casing 12 having a first diameter, and when positioned opposite the openings 13, the expandable tubular is expanded to a second and larger diameter until the sealing elements 6 are pressed in between the downhole expandable tubular 1 and the inner face 2 of the casing 12, as shown in the encircled enlarged view. Since the sealing elements 6 are arranged between first and second circumferential edges 3, 4 on opposite sites of the perforated zone of openings 13, the zone is sealed off and the well fluid from the formation is prevented from flowing in through the openings 13.

Figure 15:
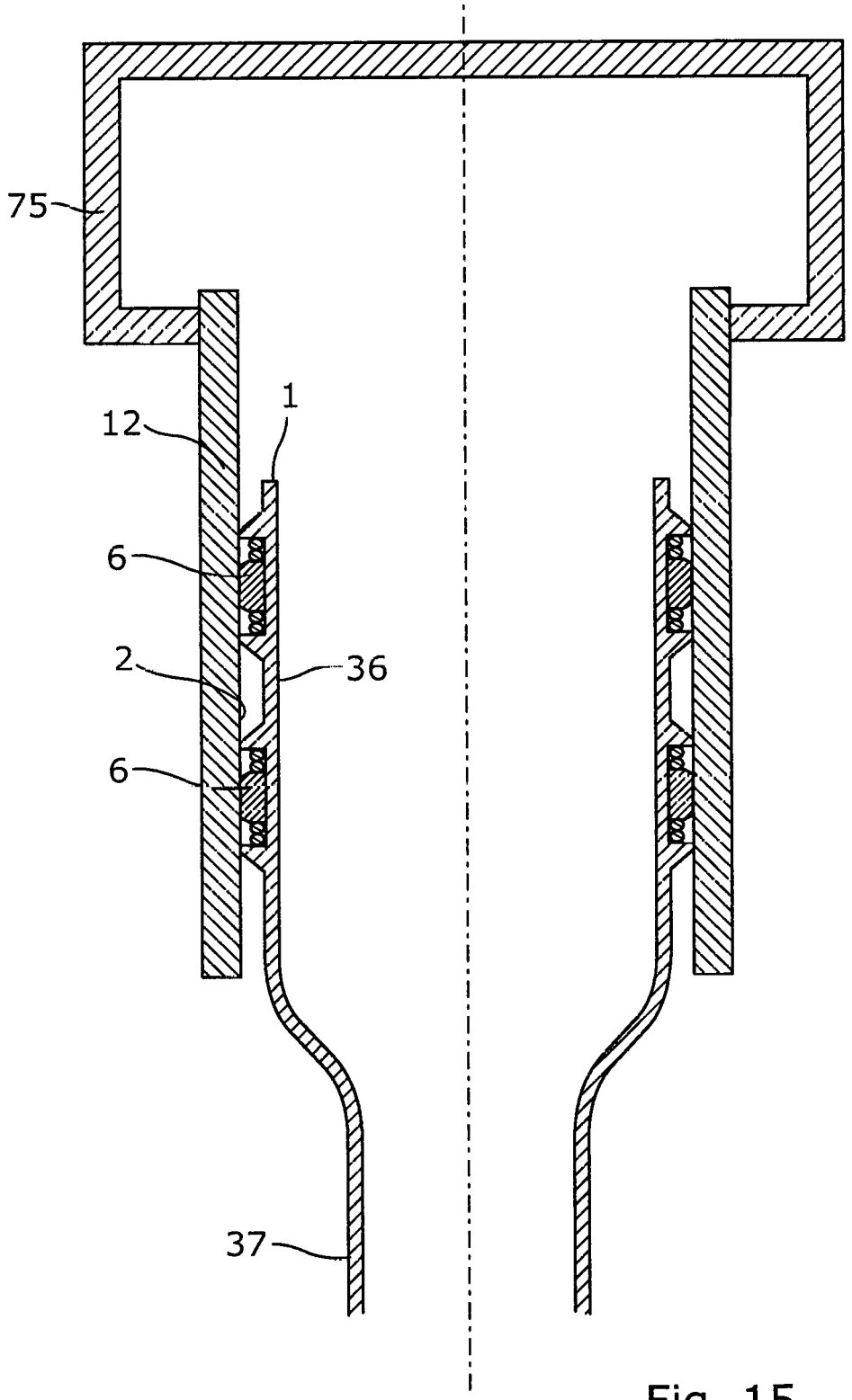
FIG. 15 shows a cross-sectional view of a downhole expandable tubular in the form of a liner hanger.

In FIG. 15, the downhole expandable tubular 1 is a liner hanger where the downhole expandable tubular 1 has been partly expanded within an upper casing 12 forming part of a well tubular structure in a well. Above the upper casing 12, a wellhead 75 may be arranged. The downhole expandable tubular 1 has a first part 36 arranged opposite the upper casing 12 and a second part 37 arranged beneath the upper casing. The first part 36 of the downhole expandable tubular 1 has been expanded until the sealing elements 6 are pressed against the inner face 2 of the casing 12 and the second part 37 of the downhole expandable tubular 1 remains unexpanded.

Figure 16:
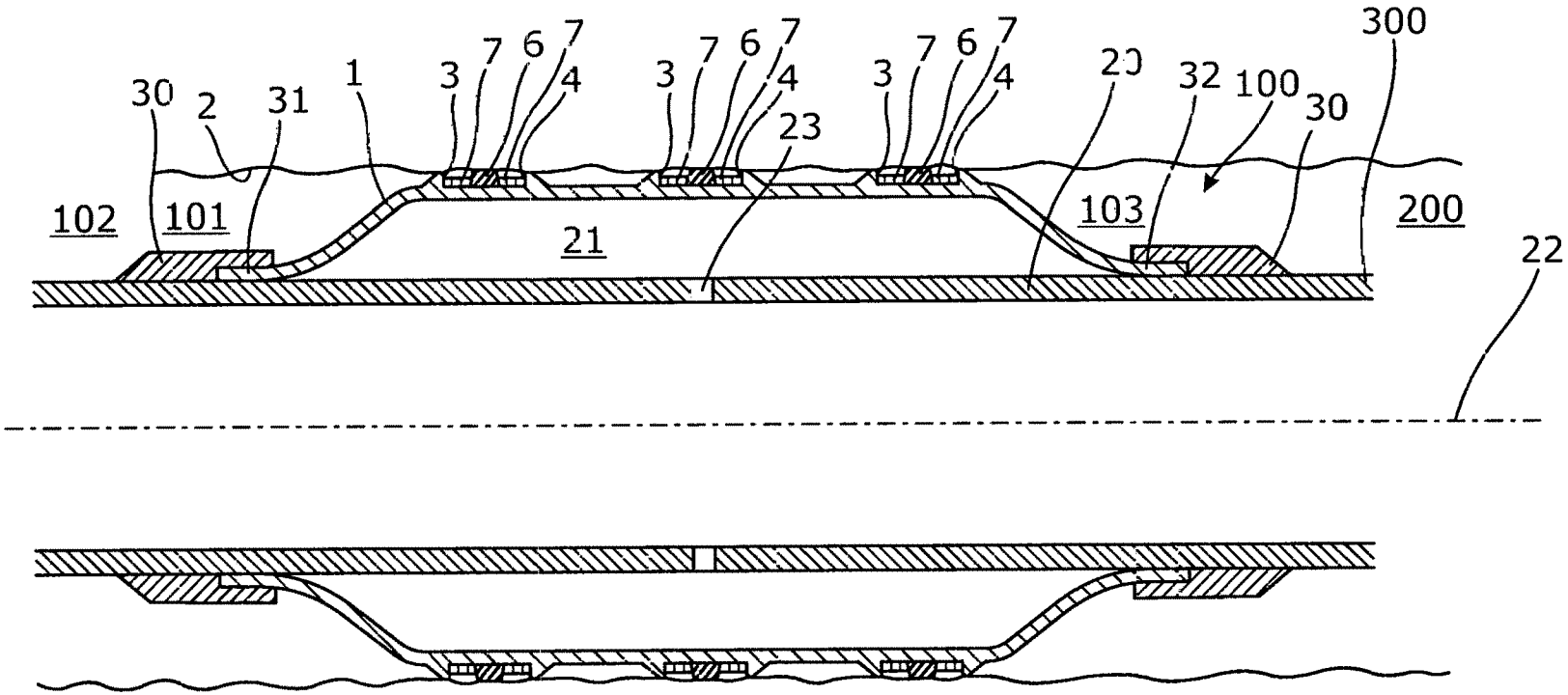
FIG. 16 shows a cross-sectional view of an annular barrier comprising a downhole expandable tubular.

FIG. 16 shows a cross-sectional view of an annular barrier 100 which has been expanded in an annulus 101 between a well tubular structure 300 and an inside face 2 of the borehole 200. The annular barrier 100 provides zone isolation between a first zone 102 and a second zone 103 of the borehole. The annular barrier 100 has an axial extension 22 which coincides with the longitudinal extension of the casing and well tubular structure 300. The annular barrier 100 comprises a tubular metal part 20, which may be a separate tubular part or a casing part for mounting a part of the well tubular structure 300. Furthermore, the annular barrier 100 comprises the downhole expandable tubular 1 which surrounds the tubular part, and each end 31, 32 of the downhole expandable tubular 1 is connected with the tubular part by means of connection parts 30. The downhole expandable tubular 1 and the tubular metal part 20 enclose an annular barrier space 21, and an expansion opening 23 is provided in the tubular part through which fluid may enter the space 21 in order to expand the downhole expandable tubular 1 as shown in FIG. 15. The downhole expandable tubular 1 is expanded until the sealing elements 6 or the projections or edges abut the inner face 2 of the borehole 200, so that fluid is prevented from flowing freely from the first zone 102 to the second zone 103.

Figure 17:
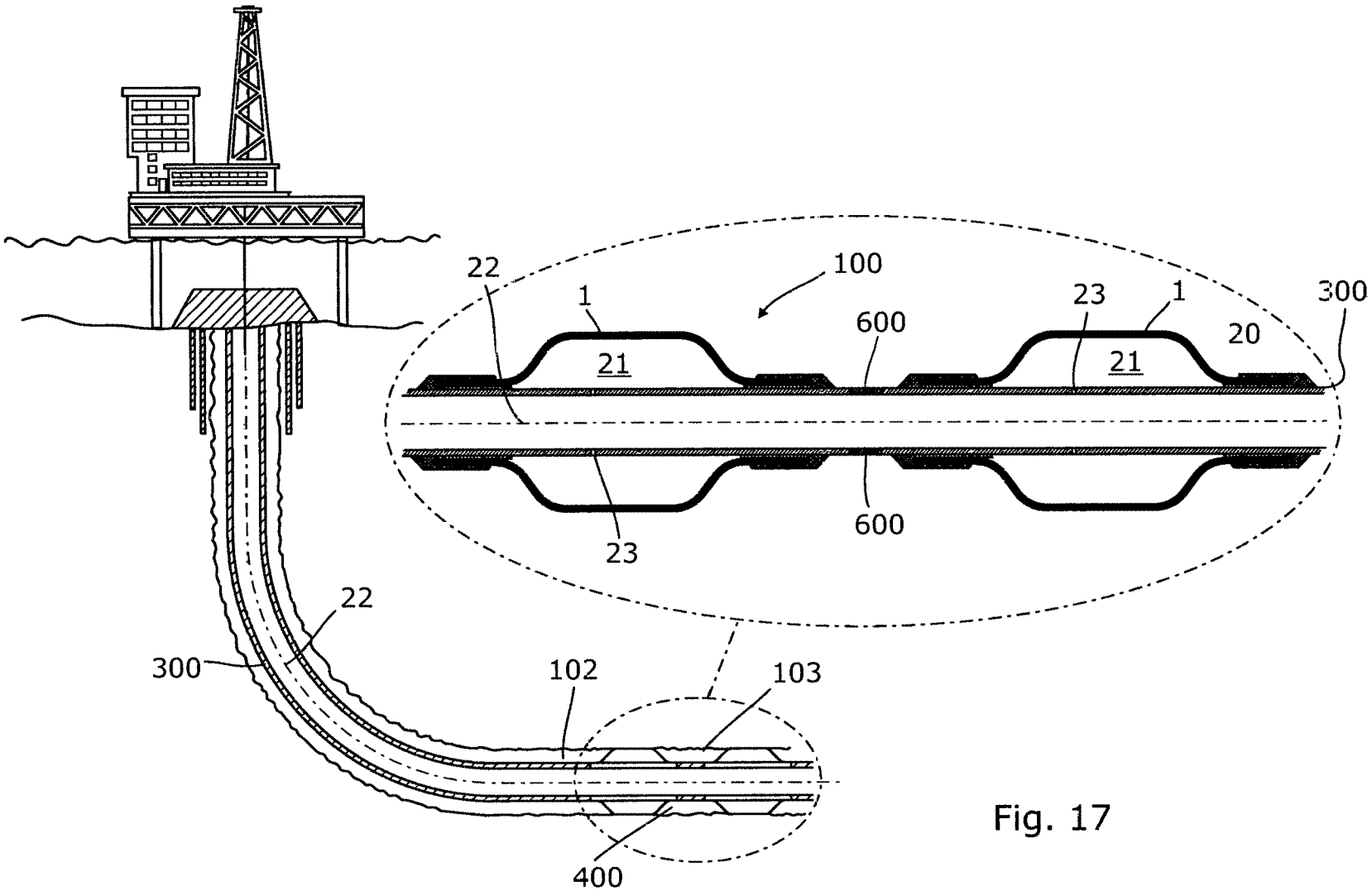
FIG. 17 shows downhole completion having an annular barrier with a downhole expandable tubular.

As shown in FIG. 17, two annular barriers 100 are often used to isolate a production zone 400. A fracturing valve or section 600, also called the frac port, is arranged in between the annular barriers 100, so that when the annular barriers 100 have been expanded, the frac port 600 is opened and fluid is let into the formation for creating fractures in the formation to ease the flow of hydrocarbon-containing fluid, such as oil, into the well tubular structure 300. The fracturing valve or section 600 may also comprise an inlet section which may be the same as the frac port. A screen may be arranged so that the fluid is filtered before flowing into the casing.

Figure 18:
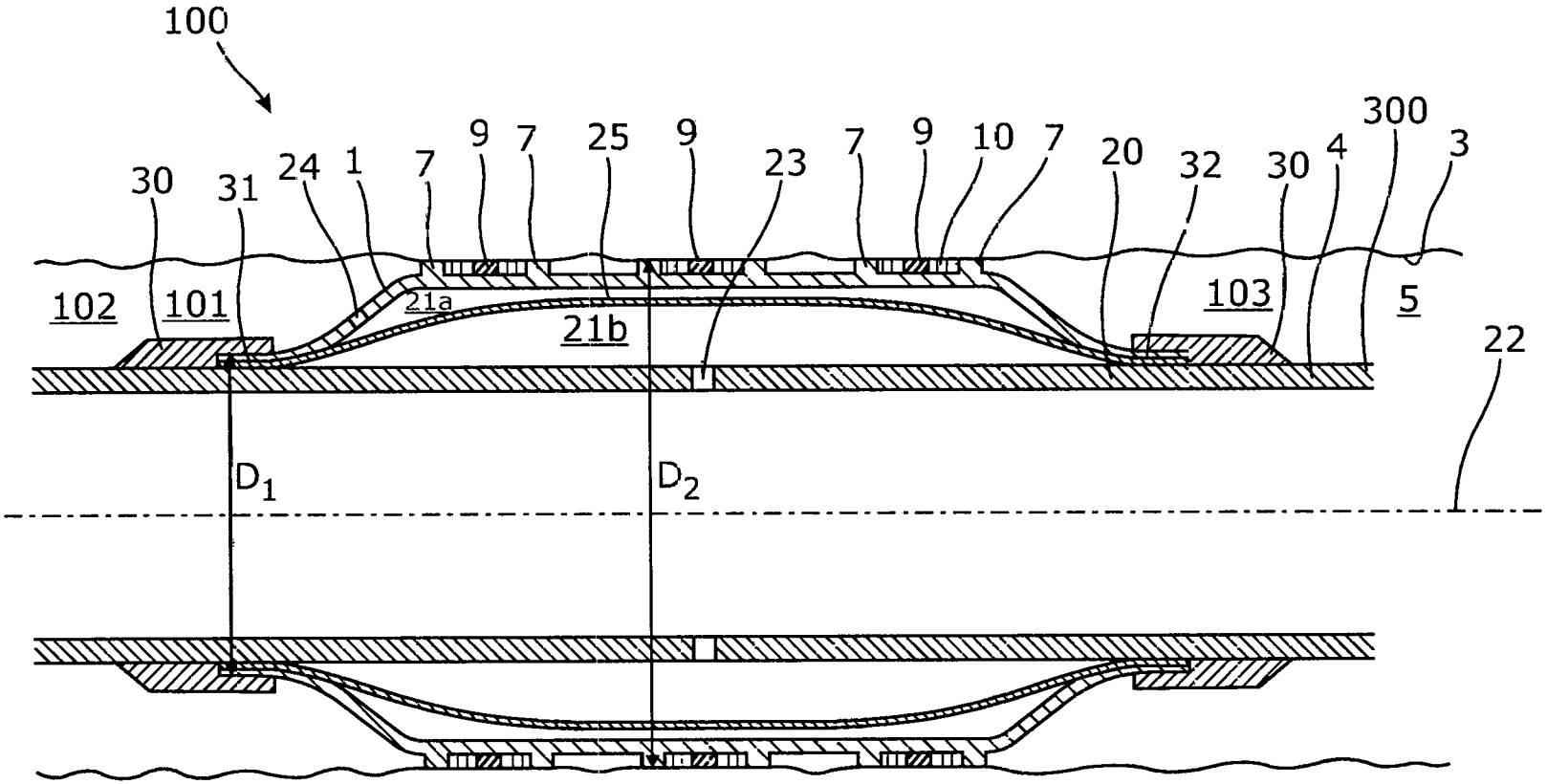
FIG. 18 shows another annular barrier having an intermediate sleeve for equalising the pressure across the downhole expandable tubular.

As shown in FIG. 18, the annular barrier further comprises a sleeve 25 arranged in between the downhole expandable tubular 1 and the tubular part 20. The sleeve 25 is connected with the tubular part 20 and the downhole expandable tubular 1, thus dividing the space into a first space section 21*a* and a second space section 21*b*. The sleeve is squeezed in between the tubular part and the downhole expandable tubular. The sleeve 25 may also be connected with the tubular part in another manner, such as crimped onto the tubular part. In order to equalise the pressure, the downhole expandable tubular has an opening 24 providing fluid communication between the first or the second zone and one of the space sections, thus equalising the pressure between the space and that zone. When e.g. performing hydraulic fracturing or another well treatment, the pressure in one of the zones in which hydraulic fracturing is performed is increasing, and in order to prevent the expandable tubular from collapsing, the fluid is let in through the opening 24 and into the first space section 21*a*. When exposed to the increased pressure, the sleeve 25 moves towards the tubular part, thus yielding to the increased pressure in the first space section 21*a*, and the first space section 21*a* increases until the pressure equalises or the sleeve abuts the tubular part.

The downhole expandable tubular part may also be crimped onto the tubular part, or, if the annular barrier comprises a sleeve, crimped onto the sleeve at its ends. The sleeve is flexible and made of metal or a polymer, such as elastomer. As shown in FIG. 18, the projection is a ring-shaped projection of an increased thickness in relation to other parts of the downhole expandable tubular, the ring-shaped projection providing an enforcement of the annular barrier when the annular barrier is expanded.

In FIG. 18, the ring-shaped retaining element 10 of the annular barrier is a split ring having three windings. In the annular barriers shown in FIGS. 16 and 18, the ends of the downhole expandable tubular may be welded to the tubular part, or the downhole expandable tubular may be crimped onto the tubular part. One end of the downhole expandable tubular may be sliding in relation to the tubular part. The tubular blank may be made of any kind of metal, such as iron, steel or stainless steel, or more ductile materials, such as copper, aluminium, lead, tin, nickel, polymers, elastomers, rubber or a combination thereof.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing is meant any kind of pipe, tubing, tubular, liner, string etc. used downhole in relation to oil or natural gas production.

Although the invention has been described in the above in connection with preferred embodiments of the invention, it will be evident for a person skilled in the art that several modifications are conceivable without departing from the invention as defined by the following claims.

The invention claimed is:

1. A downhole expandable tubular to be expanded in a well downhole from a first outer diameter ($D_1$) to a second outer diameter ($D_2$) to abut against an inner face of a casing or borehole, the downhole expandable tubular having an outer face and a longitudinal extension (l) and comprising:

at least one first circumferential edge and at least one second circumferential edge provided on the outer face and spaced apart in the longitudinal extension, wherein a sealing element and a split ring-shaped retaining element are arranged between the first and second circumferential edges, the split ring-shaped retaining element forming a back-up for the sealing element, wherein the split ring-shaped retaining element has more than one winding, so that when the expandable tubular is expanded from the first outer diameter ($D_1$) to the second outer diameter ($D_2$), the split ring-shaped retaining element expands with the expandable tubular and partly unwinds, a groove, the groove extending radially inward from the outer face of the tubular, wherein the split ring-shaped retaining element and the sealing element are both located within the groove, and the groove has a fixed width, the groove including an inner surface, a first groove wall that extends radially outward from the inner surface and a second groove wall that extends radially outward from the inner surface, wherein the split ring-shaped retaining element maintains contact with the first groove wall when the expandable tubular is expanded from the first outer diameter ($D_1$) to the second outer diameter ($D_2$), and wherein the split ring-shaped retaining element provides a longitudinal force parallel to the longitudinal extension to the sealing element to maintain a longitudinal position of the sealing element within the groove.

2. A downhole expandable tubular according to claim 1, wherein the split ring-shaped retaining element is arranged in an abutting manner to the sealing element.

3. A downhole expandable tubular according to claim 1, wherein the split ring-shaped retaining element unwinds by less than one winding when the expandable tubular is expanded from the first outer diameter ($D_1$) to the second outer diameter ($D_2$).

4. A downhole expandable tubular according to claim 1, wherein the split ring-shaped retaining element has more than one winding in the second outer diameter ($D_2$) of the downhole expandable tubular.

5. A downhole expandable tubular according to claim 1, wherein the split ring-shaped retaining element has a plurality of windings.

6. A downhole expandable tubular according to claim 1, wherein the downhole expandable tubular has a first thickness ($T_1$) between the first and second circumferential edges and a second thickness ($T_2$) in adjacent areas, the first thickness ($T_1$) being smaller than the second thickness ($T_2$).

7. A downhole expandable tubular according to claim 1, wherein the split ring-shaped retaining element and the sealing element substantially fill a gap provided between the first and second circumferential edges.

8. A downhole expandable tubular according to claim 1, wherein the split ring-shaped retaining element is made of a spring material.

9. A downhole expandable tubular according to claim 1, wherein the split ring-shaped retaining element is arranged on a first side of the sealing element, and a second split ring-shaped retaining element is arranged on another side of the sealing element opposite the first side.

10. A downhole expandable tubular according to claim 1, wherein the split ring-shaped retaining element retains the sealing element in a position along the longitudinal extension of the downhole expandable tubular while expanding the split ring-shaped retaining element and the sealing element.

11. A downhole expandable tubular according to claim 1, wherein the ring-shaped retaining element is a split ring.

12. A downhole expandable tubular according to claim 1, wherein the first and second circumferential edges are part of the groove.

13. A downhole expandable tubular according to claim 1, wherein the first and second circumferential edges are extending in a radial extension in relation to the downhole expandable tubular, said radial extension being perpendicular to the longitudinal extension (l) of the downhole expandable tubular.

14. A downhole expandable tubular according to claim 1, wherein an intermediate element is arranged between the split ring-shaped retaining element and the sealing element.

15. A downhole expandable tubular according to claim 14, wherein the split ring-shaped retaining element and the intermediate element are arranged in an abutting manner to the sealing element, so that at least one of the split ring-shaped retaining element and the intermediate element abuts the sealing element.

16. A downhole expandable tubular according to claim 1, wherein the downhole expandable tubular is a patch to be expanded within a casing or well tubular structure in a well, a liner hanger to be at least partly expanded within a casing or well tubular structure in a well, or a casing to be at least partly expanded within another casing.

17. An annular barrier to be expanded in an annulus between a well tubular structure and an inside wall of a borehole or a casing downhole for providing zone isolation between a first zone and a second zone of the borehole, comprising:

a tubular part for mounting as part of the well tubular structure, a downhole expandable tubular according to claim 1, surrounding the tubular part and having an outer face facing towards the inside wall of the borehole or the casing, each end of the downhole expandable tubular being connected with the tubular part, a space between the downhole expandable tubular and the tubular part, and an expansion opening in the tubular part through which fluid may enter into the space in order to expand the downhole expandable tubular.

18. An annular barrier according to claim 17, wherein a sleeve is arranged in between the downhole expandable tubular and the tubular part, the sleeve being connected with the tubular part and the downhole expandable tubular, thus dividing the space into a first space section and a second space section.

19. A downhole completion comprising a downhole expandable tubular according to claim 1, and a casing having an inner face against which at least part of the downhole expandable tubular is expanded.

20. A downhole completion comprising a well tubular structure and an annular barrier according to claim 17, where the tubular part of the annular barrier is mounted as part of the well tubular structure.

21. A downhole expandable tubular according to claim 1, wherein the sealing element has a distal end and a proximal end, the proximal end located adjacent the outer face of the downhole expandable tubular and the distal end being spaced from the outer face of the downhole expandable tubular, wherein the split ring-shaped retaining element supports the proximal end of the sealing element and allows the distal end to deform.

22. A downhole expandable tubular according to claim 21, wherein the distal end is a free end.

23. A downhole expandable tubular according to claim 1, wherein the first edge and the second edge are integral with the outer face of the tubular.

24. A downhole expandable tubular according to claim 1, wherein the split ring-shaped retaining element applies force along the longitudinal extension of the tubular.

* * * * *